US007798046B2

(12) United States Patent
Burkholder et al.

(10) Patent No.: US 7,798,046 B2
(45) Date of Patent: Sep. 21, 2010

(54) MORTAR BLAST ATTENUATOR DIFFUSER

(75) Inventors: Daniel E. Burkholder, Maurepas, LA (US); William A. Kaplan, Albuquerque, NM (US); Thomas W. Hensley, Albuquerque, NM (US)

(73) Assignee: Honeywell International Inc., Morristown, NJ (US)

( * ) Notice: Subject to any disclaimer, the term of this patent is extended or adjusted under 35 U.S.C. 154(b) by 397 days.

(21) Appl. No.: 11/385,464

(22) Filed: Mar. 21, 2006

(65) Prior Publication Data

US 2007/0221051 A1 Sep. 27, 2007

(51) Int. Cl.
*F41A 21/32* (2006.01)

(52) U.S. Cl. ..... 89/14.3

(58) Field of Classification Search ..... 89/14.3, 89/6.5

See application file for complete search history.

(56) References Cited

U.S. PATENT DOCUMENTS

| | | | | | |
|---|---|---|---|---|---|
| 1,435,084 | A | * | 11/1922 | Schneider | 89/14.3 |
| 1,817,058 | A | * | 8/1931 | Bierbaum | 42/78 |
| 2,206,568 | A | * | 7/1940 | Hughes | 89/14.3 |
| 2,457,802 | A | * | 1/1949 | Bauer | 89/14.3 |
| 3,516,326 | A | * | 6/1970 | Donner | 89/14.3 |
| 3,528,336 | A | * | 9/1970 | Donner | 89/14.3 |
| 4,457,206 | A | | 7/1984 | Toulios et al. | 89/14 R |
| 5,370,603 | A | | 12/1994 | Newman | |
| 5,394,690 | A | | 3/1995 | Arszman et al. | |
| 5,407,237 | A | | 4/1995 | Smolowitz | |
| 5,425,310 | A | | 6/1995 | Weber | |
| 5,487,311 | A | | 1/1996 | Guativa et al. | |
| 5,530,214 | A | | 6/1996 | Morehead et al. | |
| 5,557,403 | A | | 9/1996 | Task | |
| 5,604,634 | A | | 2/1997 | Khoury et al. | |
| 5,626,166 | A | | 5/1997 | Hassan | |
| 5,647,916 | A | | 7/1997 | Guazzoni | |
| 5,653,807 | A | | 8/1997 | Crumbaker | |
| 5,745,234 | A | | 4/1998 | Snail et al. | |

(Continued)

FOREIGN PATENT DOCUMENTS

CH 693 248 A5 9/1998

(Continued)

OTHER PUBLICATIONS

European Search Report for 07104467.1-1260 dated Jul. 23, 2007.

*Primary Examiner*—Stephen M Johnson
(74) *Attorney, Agent, or Firm*—Shumaker & Sieffert, P.A.

(57) ABSTRACT

An orifice entry diverging multi vane conical venturi diffuser for a mortar tube that provides a surface at the discharge end of a mortar tube for measuring or sensing instruments. The internal,vanes comprise the primary surface and the conical venturi wall comprises the secondary surface. This apparatus allows a solid object of the equivalent diameter of the entry orifice when propelled by gas pressure to travel through the diffuser into the open atmosphere while at the same time providing an increasing volumetric flow path for the discharge of the propellant gas. The vanes axial parallel primary surface area is used to provide a port for instrumentation. The area between the primary and secondary surfaces of circumferentially spaced vanes provides the gas flow channels when the center section formed by the vanes primary surfaces is obstructed by a solid object with the equivalent diameter of the entry orifice.

11 Claims, 7 Drawing Sheets

U.S. PATENT DOCUMENTS

| | | | |
|---|---|---|---|
| 5,751,609 | A | 5/1998 | Schaefer, Jr. et al. |
| 5,821,475 | A | 10/1998 | Morehead et al. |
| 5,890,101 | A | 3/1999 | Schaefer, Jr. et al. |
| 5,901,272 | A | 5/1999 | Schaefer, Jr. et al. |
| 5,926,265 | A | 7/1999 | Task et al. |
| 5,938,118 | A | 8/1999 | Cooper |
| 5,960,026 | A | 9/1999 | Nolting et al. |
| 5,961,895 | A | 10/1999 | Sanford |
| 5,981,949 | A | 11/1999 | Leahy et al. |
| 6,032,567 | A | 3/2000 | Jones et al. |
| 6,047,541 | A | 4/2000 | Hampstem |
| 6,047,644 | A | 4/2000 | Malecki et al. |
| 6,051,846 | A | 4/2000 | Burns et al. |
| 6,105,716 | A | 8/2000 | Morehead et al. |
| 6,148,713 | A | 11/2000 | Giéseke |
| 6,165,801 | A | 12/2000 | Burns et al. |
| 6,194,701 | B1 | 2/2001 | Task et al. |
| 6,210,128 | B1 | 4/2001 | Rife et al. |
| 6,228,657 | B1 | 5/2001 | Genovese et al. |
| 6,245,009 | B1 | 6/2001 | Travis et al. |
| 6,344,232 | B1 | 2/2002 | Jones et al. |
| 6,346,141 | B1 | 2/2002 | Nuckols et al. |
| 6,382,912 | B1 | 5/2002 | Lee et al. |
| 6,397,577 | B1 | 6/2002 | Sondergaard |
| 6,403,366 | B1 | 6/2002 | Kim |
| 6,408,777 | B1 | 6/2002 | Beauchamp |
| 6,412,416 | B1 | 7/2002 | Rouse et al. |
| 6,456,240 | B1 | 9/2002 | Cesulka |
| 6,523,478 | B1 | 2/2003 | Gonzalez et al. |
| 6,544,347 | B2 | 4/2003 | Lucey, Jr. et al. |
| 6,568,052 | B1 | 5/2003 | Rife et al. |
| 6,637,705 | B2 | 10/2003 | Sjoblom et al. |
| 6,655,313 | B1 | 12/2003 | Woodall et al. |
| 6,688,032 | B1 | 2/2004 | Gonzalez et al. |
| 6,748,844 | B2 * | 6/2004 | Ang ..... 89/37.05 |
| 6,779,345 | B2 | 8/2004 | Girouard |
| 6,796,307 | B1 | 9/2004 | Hughson et al. |
| 6,797,191 | B2 | 9/2004 | Philips et al. |
| 6,880,444 | B2 * | 4/2005 | Ang ..... 89/14.4 |
| 6,948,306 | B1 | 9/2005 | Wilson et al. |
| 2003/0154849 | A1 * | 8/2003 | Breuer ..... 89/14.3 |
| 2005/0252365 | A1 * | 11/2005 | Balbo et al. ..... 89/14.3 |

FOREIGN PATENT DOCUMENTS

| | | |
|---|---|---|
| EP | 0 035 802 | 1/1981 |
| EP | 0 108 973 A1 | 10/1983 |
| EP | 0 331 670 | 2/1989 |
| WO | WO 2006/078455 A1 | 7/2006 |

* cited by examiner

MORTAR BLAST ATTENUATOR DIFFUSER

GOVERNMENT RIGHTS

The U.S. Government has a paid-up license in this invention and the right in limited circumstances to require the patent owner to license others on reasonable terms as provided for by the terms of DAAE30-03-D-1004, awarded by the Department of the Army.

BACKGROUND OF THE INVENTION

1. Field of the Invention (Technical Field)

The present invention relates to mortars and more particularly to a diffuser for a mortar barrel that is configured to provide a surface for instrumentation installation that is unaffected by the mortar blast.

2. Background Art

There is a need to provide a non invasive port in close proximity and perpendicular to the mortar round axis of travel during firing without penetrating the mortar tube or path of mortar travel and without obstructing the flow of propellant gases. This invention being necessary to attach various analytical instrumentation for the collection of real time data to aid in the functions of the mortar fire control system (MFCS) and in the operational evaluation of the 120 mm mortar through attachment on the end of the 120 mm mortar barrel. The requirements to collect data on the mortar round and the operating parameters of the 120 mm mortar are very restrictive due to the destructive nature, extreme physical environment, and the engineering techniques involved interfacing the monitoring instrumentation which can survive in this environment.

The problem with discharge of the spent propellant gases through the existing smooth wall conical venturi produces an uneven flow and pressure build up between the mortar round and a random section of the wall of the venturi which occurs as the mortar round exits the barrel. The diverging conical wall of the existing blast attenuator device (BAD) provides no means of porting the gases along the wall without asymmetrically disturbing the gas flow path and no method to control a gap dimension between the mortar round and the in situ instrument interface.

Some prior art methods and devices have been provided to solve the problem in the past by using a cylindrical interface collar between the mortar barrel end and the BAD effectively lengthening the overall dimension of the barrel and position of the BAD discharge cone in reference to its mounted carrier, like in a M1064 vehicle.

The disadvantages and shortcomings of this previous approach is that a cylindrical interface collar, aside from exceeding the overall length restrictions, does not provide a sufficient increase in volume for the expansion and reduction of discharge gas pressure at the muzzle end of the barrel when the necessary gap dimension is maintained thereby imparting additional effective length to the muzzle end of the barrel.

These prior art approaches do not provide a combined instrument interface and a blast attenuation function for a mortar.

SUMMARY OF THE INVENTION (DISCLOSURE OF THE INVENTION)

The present invention comprises of vanes in an otherwise smooth conical venturi inner surface and the design permits the vanes to terminate by faring to the edge of the exit diameter of the venturi. The structure afforded by this design allows for the exhaust of high-pressure gas, and the stabilization of the round and the close proximity parallel surface for the interfacing of instrumentation. The new vaned design provides a symmetrical discharge gas flow path at the muzzle end of the mortar tube, while maintaining a dimensionally controlled surface parallel to the mortar round in which ports can be designed to accommodate instrumentation.

The present invention provides a solution to the problem of placing sensitive measuring instruments near a fired mortar round. It was traditionally thought that it would not be possible to make or place a physical device or instrument in close proximity to the mortar round beyond the end of the mortar tube inside a blast attenuator device without disturbing the gas flow and/or contacting the round thereby defeating the purpose of the blast attenuation function.

A primary purpose of the present invention is to provide for instrumentation on the exit of a mortar barrel without affecting the performance of the mortar round while at the same time protecting and accurately positioning the instrumentation.

A primary advantage of the present invention is that it provides a directed symmetrical flow of propellant exhaust gas aiding in stabilization of the mortar round ballistic as it exits the barrel.

Another advantage of the invention is that it provides parallel-ported surfaces for mounting of in situ instrumentation with out penetrating the mortar barrel or interfering with the round during exit from the mortar tube BAD.

A further advantage of the invention is the intentional design to be a one-piece unit not requiring additional parts for attachment to the muzzle end of the mortar.

Yet another advantage of the invention is, adaptability to many other weapon platforms where close proximity sensing is required.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Best Modes For Carrying Out The Invention

Figure 1:
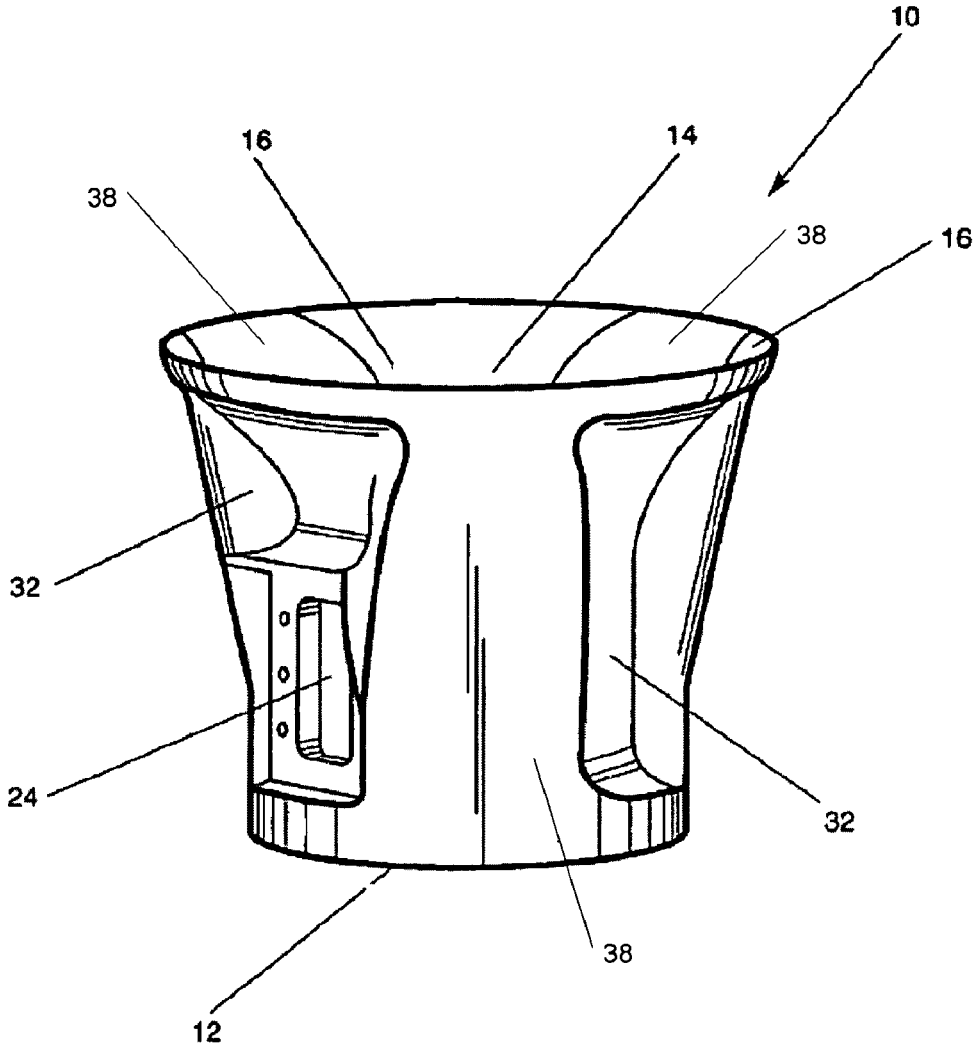
FIG. 1 shows the preferred embodiment of the present invention.
Figure 2:
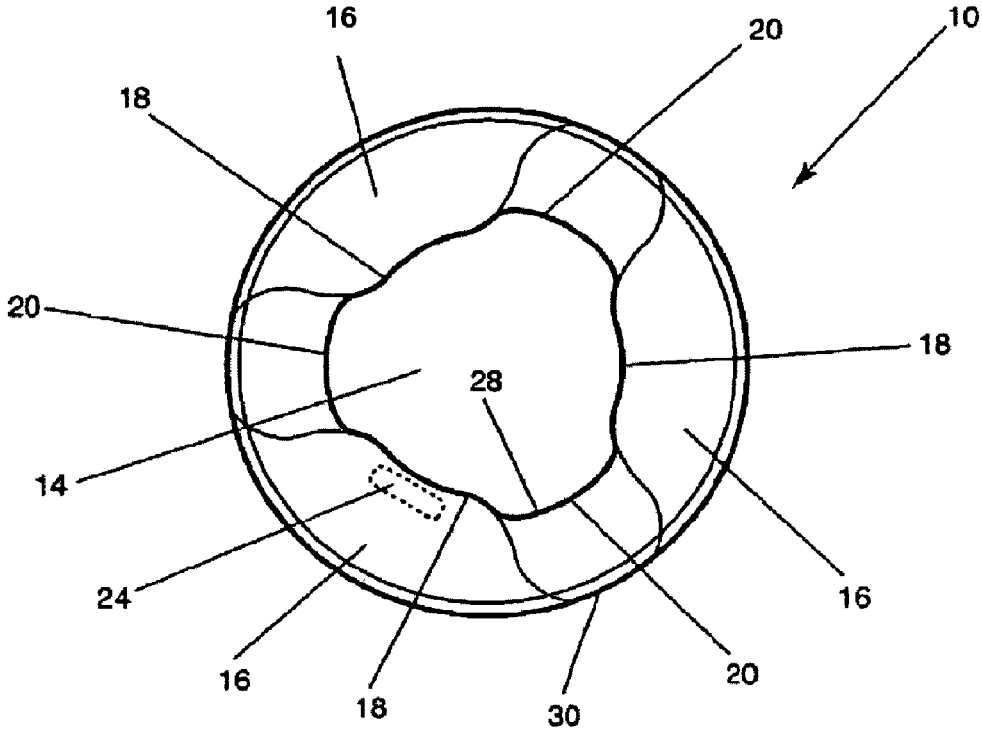
FIG. 2 is a top view of the embodiment of FIG. 1.
Figure 3:
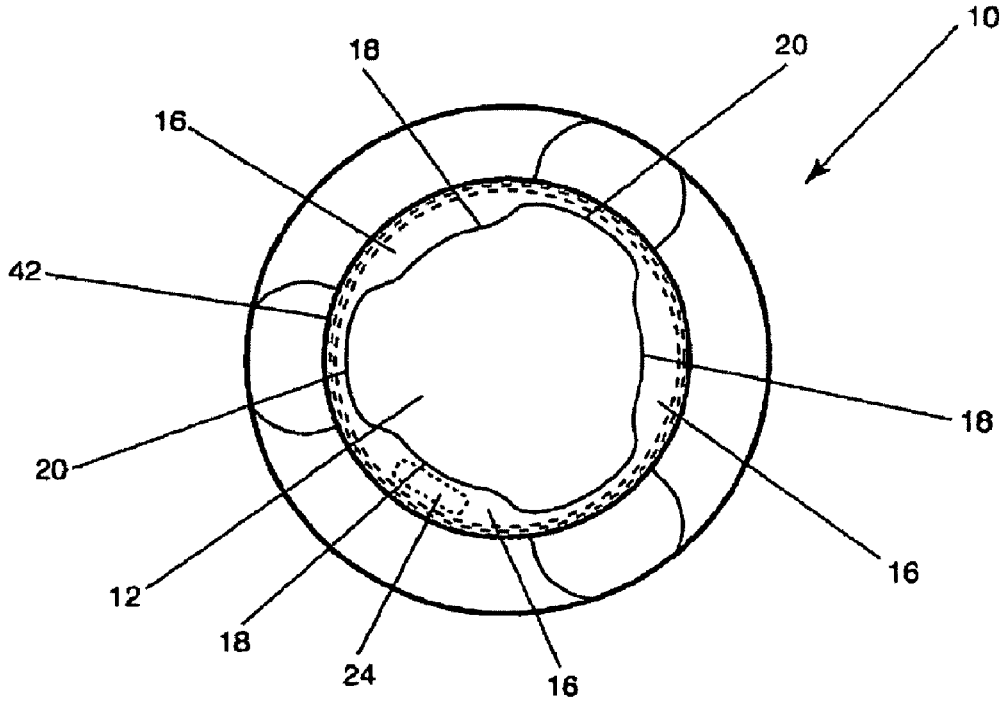
FIG. 3 is a bottom view of the embodiment of FIG. 1

FIG. 1 shows a perspective view of the preferred embodiment of the invention while FIG. 2 shows a top view and FIG. 3 shows a bottom view of the same embodiment. The present invention comprises an entry orifice 12 and exit orifice 14 of a conical cylindrical diffuser 10 containing multiple vanes 16 traversing the interior walls in the longitudinal axis (hereinafter diffuser). The vanes 16 refer to a surface with a special shape used to direct fluid or gas flow. Internal vanes 16 comprise of primary or outer surface 18 and the conical venturi internal surface 38 comprises secondary or inner surface 20, as shown in FIG. 2. This secondary or inner surface 20 flares out from a predetermined inner dimension 28 at entry orifice 12 to a predetermined outer dimension 30 at exit orifice 14. This invention allows a solid object, such as a round or projectile 22 of the equivalent diameter of entry orifice 12 when propelled by gas pressure to travel through diffuser 10 into the open atmosphere while at the same time providing an increasing volumetric flow path through the chambers formed by the surface dimensions of the projectile and the internal surfaces 38 for the discharge of the propellant gas. By using this configuration the high pressure gas created during a firing event is channeled through secondary or inner surface 20 thereby essentially providing and equally distributing, centering, and stabilizing force around the projectile as it exits the diffuser. The vanes axial parallel primary surface 18 provides a port 24 for instrumentation. Port 24 preferably contains holes with threads or threaded inserts for installation of external instrumentation. The area between the primary 18 and secondary surfaces 20 of circumferentially spaced vanes 16 provides the gas flow channels when the center section formed by the vanes primary surfaces 18 is obstructed by a solid object 22 with the equivalent diameter of the entry orifice 12. The preferred embodiment further preferably has threads on the outside of entry orifice 12 for affixing diffuser 10 to the mortar barrel muzzle end 34. The invention can also optionally contain reverse contour outside cuts 32 of the inside vanes for weight relief and invention handling. These cuts 32 could also be modified to be ribbed or other designs of material removal to accomplish weight relief and combined cooling effects and the invention would still operate as intended (not shown). Although the present description shows a three (3) vane configuration, the number of vanes can be increased or decreased depending on the particular system requirements, thus this description is not meant to limit the number of vanes to the embodiments as shown.

Figure 4:
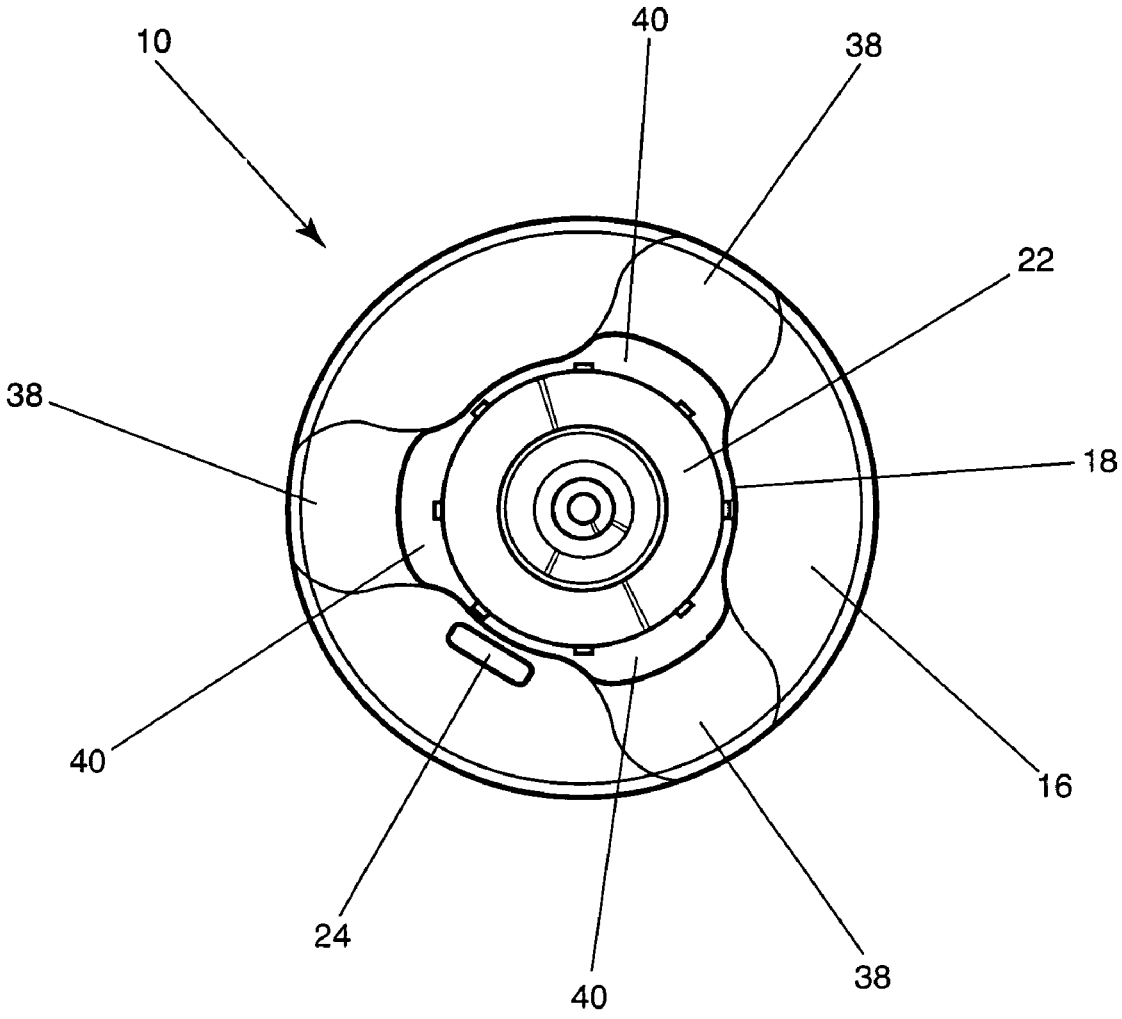
FIG. 4 is the embodiment of FIG. 2 with a mortar round inserted.
Figure 5:
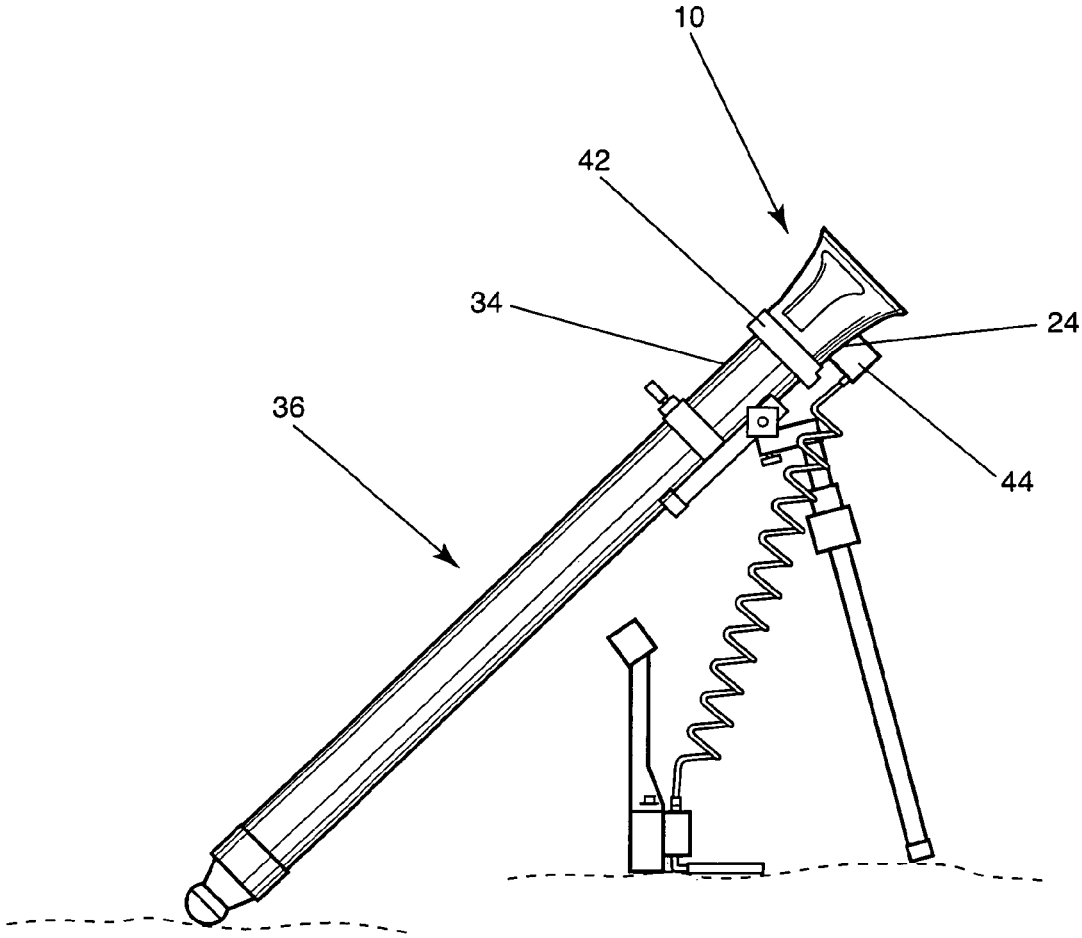
FIG. 5 shows the preferred diffuser attached to a mortar and associated equipment.

As shown in FIGS. 4 and 5 the base or entry orifice 12 of diffuser 10 being of the same diameter and attached to the muzzle end 34 of a 120 mm mortar, allows mortar round 22 to travel into diffuser 10 at this point. At orifice entry 12 primary surfaces 18 of vanes 16 continue on a parallel plane along the axis of mortar barrel 36. The diverging conical venturi of the internal surface 38 of diffuser 10 also begins at entry orifice 12. The physical difference between the diverging conical venturi internal surface 38 of diffuser 10 and the three parallel surfaces forming primary surface 18 of vanes 16 produce a channel 40 which increase in volume along the length of diffuser 10. As round 22 exits barrel 36 and enters diffuser 10 the propellant gas pressure is exhausted along channels 40 formed by the projectile and the three adjacent internal surfaces 38 and the blast directed upward and outward away from the end 34 of the mortar tube 36. An equal distribution of gas pressure in each of the three channels 40 spaced one hundred and twenty degrees (120°) around the internal wall of diffuser 10 causes round 22 to stabilize during its exit. Although the preferred embodiment as described, indicates spacing of one hundred and twenty degrees (120°), other values can be used and optimized to operation of the diffuser. Port 24 on primary surface 18 of vane 16 allows for an instrument assembly to be mounted in close proximity to round 22 for interaction with round 22 during firing without disturbing the primary functions of the diffuser or the ballistics of round 22.

FIG. 5 represents a model of the associated equipment for the new diffuser in its current application. Diffuser 10 is clamped to the threaded clamp collar, which then slides onto the 120 mm mortar barrel and is locked into position. The external instrumentation 44 is attached to diffuser 10 with fasteners, such as screws and oriented as indicated for specific use.

Preferably, each part of this invention is combined into a one-piece component during the machining and fabrication, which comprises the finished product. In this manner, there are no separate parts to potentially disturb the air-flow or compromise the structural integrity. The preferred diffuser is made from 4140 or 4340 chromyl steel. Change of construction materials to another material such as titanium or another composite material could be completed without changing the basic invention. This material change would have to be completed with careful consideration for survival of the assembly in its operating environment. Implementation of multiple ports would not change the basic operation of the invention and could be cut into the three primary vane surfaces. Changing the angle of divergence of the vane primary and secondary surfaces could under careful design consideration be substituted for the current angle of divergence without changing the basic invention.

Outside cutouts can optionally be reconfigured in a manner where reverse vane contours are no longer used and a ribbed format is implemented and used to aid convective cooling. A handle could be added to diffuser 10 that would allow a user to carry the unit by holding an external part connected to diffuser 10 without carrying the unit from the inlet or outlet orifice (not shown). A cover could be produced for the inlet and outlet orifice of diffuser 10 in order to protect against the elements as well as premature loading of the ballistic (not shown). A port cover could be incorporated in order to allow for the port during service or absence of analytical instrumentation (not shown).

Critical tolerances of this unit are an essential limitation of operation. Due to the object moving through diffuser 10, tight tolerances are required in order to maintain the inside parallel surface diameter to the passing object. Weight considerations are limiting to the invention due to the human interface aspect of diffuser 10 where a user must be able to remove the unit as a single user without assistance. Ranges of size are also critical to proper invention functionality as length and diameter are critical sizes to this invention. Length of diffuser 10 is required to be the same as the conical diverging venturi internal surfaces 38 in order to maintain the overall length of the install system that the invention is attached to. Overall diameter of the invention is critical for pressure relief and gas flow and therefore cannot exceed dimensions provided. Diameter is limited subsequently by the noninvasive port designed into the diffuser, as a large diameter would render potential uses of the port to a distance outside the operable range. Pressure relief and specifications are also a limiting factor for this design as pressure relief for a high-pressure event must be controlled and loss of pressure is specific with primary and secondary vaned surfaces for the mortar blast attenuator diffuser.

The invention is intended to be threaded 42 to a collar that mates to the 120 mm mortar tube 34. After threading diffuser 10 to the collar attach the collar as intended and insert external instrumentation 44 into port 24 using intended fasteners. As this is an in situ component operation consists of gas flow pressure relief with provision for increase in volumetric flow path for the discharge of propellant gas while allowing an object 22 to enter and exit diffuser 10 through the inlet 12 and outlet 14 orifices.

Figure 6:
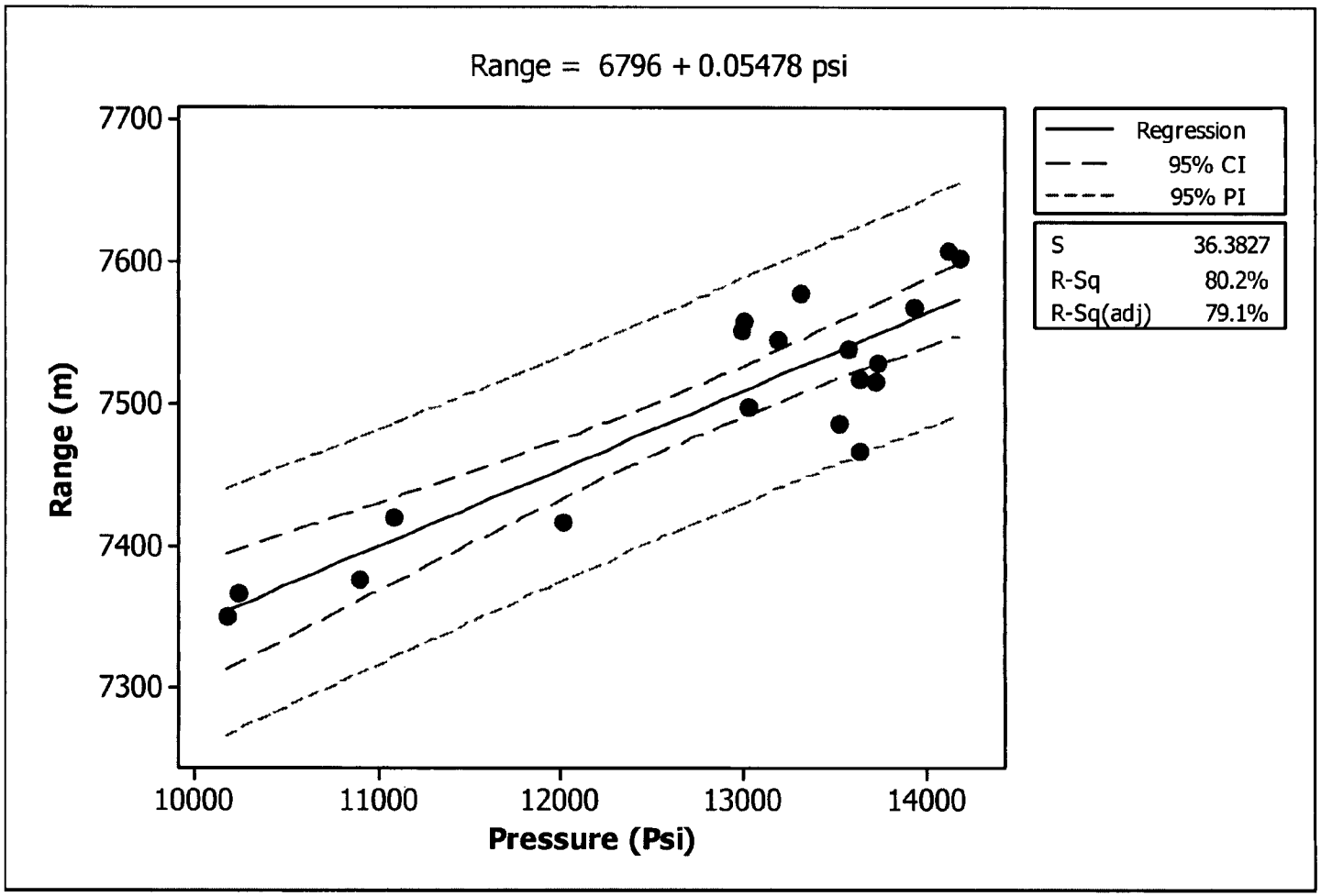
FIG. 6 is a graph showing a regression analysis of object range vs. pressure.
Figure 7:
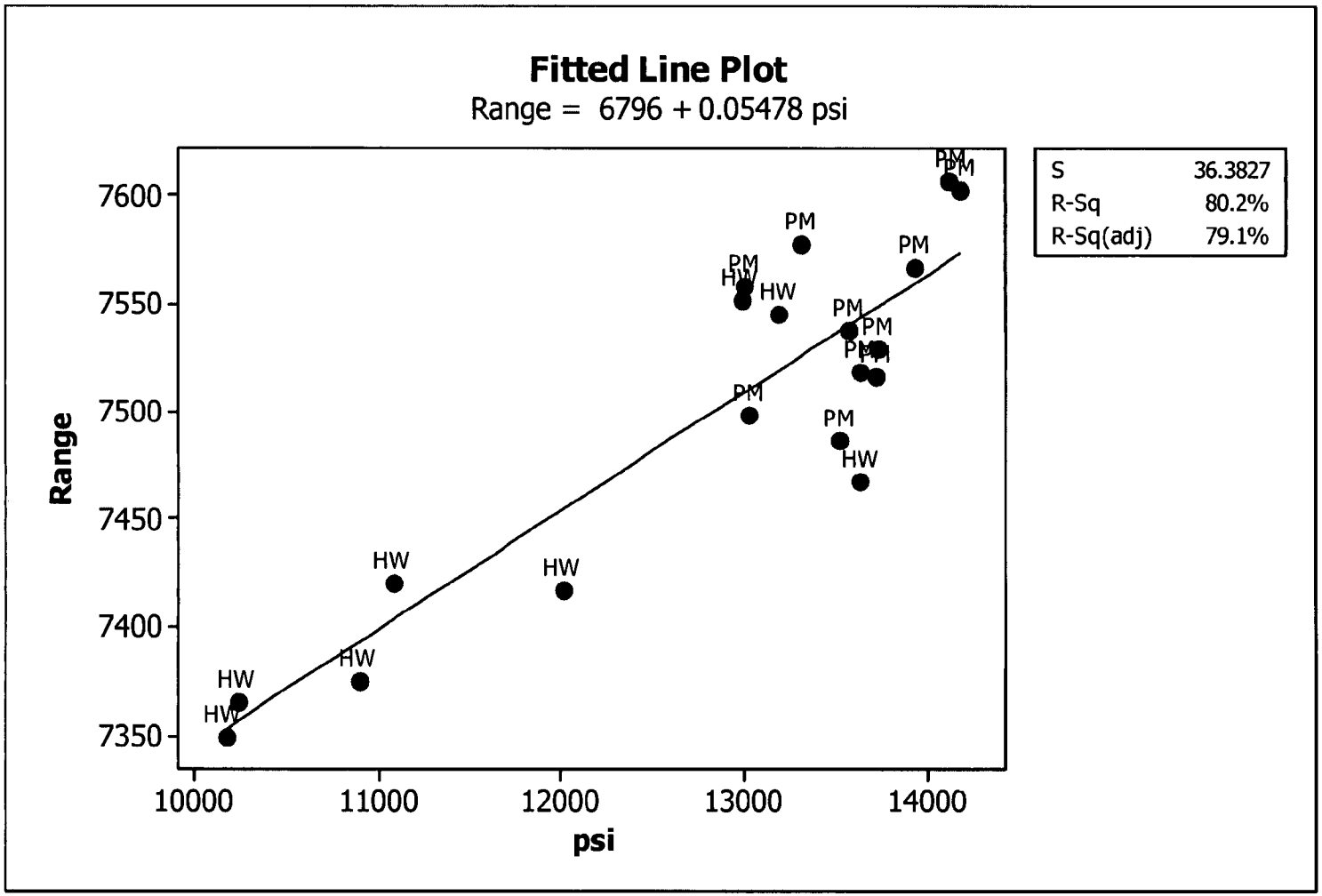
FIG. 7 is a graph showing a regression analysis of a prior art diffuser vs. the present invention.
Figure 8:
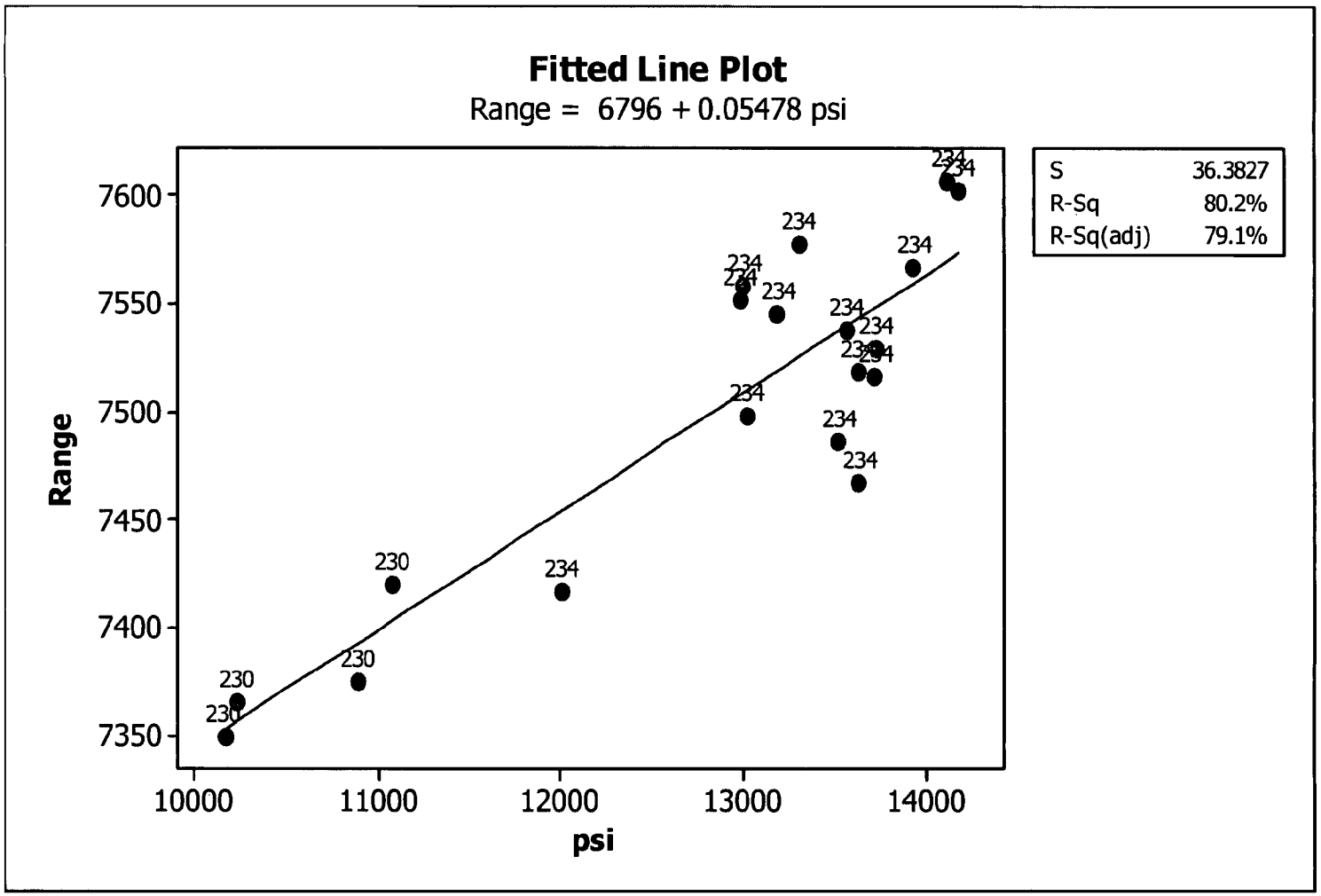
FIG. 8 shows a regression analysis of lot number for range vs. pounds per square inch (psi).

Quantitative analysis was completed to prove that the present invention did not impact object range distance as compared to a prior art diffuser. Results were obtained from a live fire activity where data was gathered from multiple object range distances collected and then analyzed through statistical analysis. FIGS. 6, 7 and 8 represent a multiple regression analysis completed from the data gathered from live fire activity.

FIG. 6 graphically shows a regression analysis comparing the mortar range versus pressure in order to show that there is not statistical significantly difference between the new BAD and the prior art diffuser. This shows that there is 79.1% variance in mortar range due to natural variance in each mortar round pressure. Range is measured in meters of flight for the mortar and psi represents pounds per square inch for pressure measurement in the mortar barrel. S variable represents source variance as R-Sq is the regression coefficient and R-Sq is the residual error.

FIG. 7 graphically shows a regression analysis comparing the prior art diffuser with the new BAD in order to compare the range of flight of the mortar round and blast pressure to show that the improved BAD does not impact the range of the mortar round. The HW variable represents the Honeywell BAD and the PM variable represents the original diffuser. Range is measured in meters of flight for the mortar and psi represents pounds per square inch for pressure measurement in the mortar barrel. S variable represents source variance as R-Sq is the regression coefficient and R-Sq is the residual error.

FIG. 8 graphically shows a regression analysis comparing differing lot numbers in order to compare the range of flight of the mortar round based on the different lots of mortar rounds. This analysis allows for further reduction of variance statistically between the new BAD and the prior art diffuser. Range is measured in meters of flight for the mortar and psi represents pounds per square inch for pressure measurement in the mortar barrel. S variable represents source variance as R-Sq is the regression coefficient and R-Sq is the residual error.

These results conclude that conical diverging venturi provides similar range performance for the propelled object as a prior art diffuser passing through the inlet and out the outlet. This data shows diffuser 10 relieves gas pressure from a high-pressure short duration event through the primary and secondary surfaces of the vanes while allowing for the implementation of a port without impacting range performance.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, are hereby incorporated by reference.

What is claimed is:

1. A mortar blast diffuser through which a round is fired, the mortar blast diffuser having a conical outer dimension and an outer surface to mount-instrumentation comprising:

at least three substantially similar vanes disposed inside the mortar blast diffuser for directing a flow of gas out an exit orifice of the mortar blast diffuser;

at least three internal surfaces located between the at least three substantially similar vanes to form a circular inner dimension that is concentric with the outer dimension of the mortar blast diffuser; and an instrumentation mounting port disposed on the outer surface of the mortar blast diffuser without disturbing gas flow and without contacting the round;

wherein when the round enters the diffuser, propellant gas is exhausted with equal pressure reduction along at least three channels formed by the round and the at least three internal surfaces, causing the round to stabilize during its exit out of the exit orifice.

2. The mortar blast diffuser of claim 1 further wherein the at least three channels are spaced equally apart.

3. The mortar blast diffuser of claim 1 wherein the at least three internal surfaces each comprise a conically diverging surface.

4. The mortar blast diffuser of claim 1 wherein the at least three internal surfaces each comprise a flared internal surface.

5. The mortar blast diffuser of claim 1 further comprising contour outside cuts disposed on the outer surface of the mortar blast diffuser.

6. A mortar blast diffuser through which a round is fired, the mortar blast diffuser having an outer surface for mounting instrumentation comprising:

at least three channels formed on the inside of the mortar blast diffuser when the round enters the diffuser, the at least three channels formed by the round and an internal surface of the mortar blast diffuser, wherein when the round enters the diffuser, propellant gas is exhausted with equal pressure reduction along the at least three channels, causing the round to stabilize during its exit out of the mortar blast diffuser; and at least one instrumentation mount disposed on the outer surface of the mortar blast diffuser without disturbing gas flow and without contacting the round.

7. The mortar blast diffuser of claim 6 wherein the at least three channels are spaced equally apart.

8. The mortar blast diffuser of claim 6 further comprising at least three substantially similar vanes disposed inside the mortar blast diffuser.

9. The mortar blast diffuser of claim 6 wherein the internal surface of the mortar blast diffuser comprises a conically diverging internal surface.

10. The mortar blast diffuser of claim 6 wherein the internal surface comprises a flared internal surface.

11. The mortar blast diffuser of claim 6 further comprising contour outside cuts disposed on the outer surface of the mortar blast diffuser.

* * * * *